US009908732B2

(12) United States Patent
Oudsen

(10) Patent No.: US 9,908,732 B2
(45) Date of Patent: Mar. 6, 2018

(54) DEVICE FOR DECURLING A WEB OF MATERIAL, SUCH AS A PAPER WEB

(71) Applicant: SDD Holding B.V., Emst (NL)

(72) Inventor: Johannes Franciscus Roland Oudsen, Epe (NL)

(73) Assignee: SDD Holding B.V., Emst (NL)

( * ) Notice: Subject to any disclaimer, the term of this patent is extended or adjusted under 35 U.S.C. 154(b) by 127 days.

(21) Appl. No.: 14/939,145

(22) Filed: Nov. 12, 2015

(65) Prior Publication Data

US 2016/0137451 A1 May 19, 2016

(30) Foreign Application Priority Data

Nov. 13, 2014 (EP) ..... 14193002

(51) Int. Cl.
*B65H 23/34* (2006.01)
*B65H 23/26* (2006.01)

(52) U.S. Cl.
CPC ..... *B65H 23/34* (2013.01); *B65H 23/26* (2013.01); *B65H 2301/44312* (2013.01); *B65H 2301/512565* (2013.01); *B65H 2404/1314* (2013.01); *B65H 2404/255* (2013.01); *B65H 2404/262* (2013.01); *B65H 2515/314* (2013.01); *B65H 2601/51* (2013.01)

(58) Field of Classification Search
CPC ..... B65H 23/34; B65H 2301/5121; B65H 2301/512565; B65H 2301/51256; B65H 2404/2532; B65H 2404/255; B65H 2404/2611; B65H 2404/2612; B65H 2404/2613
See application file for complete search history.

(56) References Cited

U.S. PATENT DOCUMENTS

| | | | | |
|---|---|---|---|---|
| 5,580,044 | A | 12/1996 | Wafler | |
| 6,189,684 | B1 * | 2/2001 | Greive | B65G 23/12 198/835 |
| 7,654,519 | B2 * | 2/2010 | Yamane | B41J 11/0005 162/197 |
| 2009/0190982 | A1 | 7/2009 | Yamamoto | |

FOREIGN PATENT DOCUMENTS

| | | | |
|---|---|---|---|
| CN | 101786555 | A | 7/2010 |
| EP | 2085347 | A2 | 8/2009 |
| JP | 61160441 | U | 10/1986 |
| JP | 200072218 | A | 3/2000 |

OTHER PUBLICATIONS

Machine translation of CN 101786555, retrieved May 15, 2017.*

* cited by examiner

*Primary Examiner* — Michael C McCullough
(74) *Attorney, Agent, or Firm* — The Webb Law Firm

(57) ABSTRACT

The invention relates to a device for decurling a web of material, such as a paper web, which device comprises: a first main roller; a second main roller arranged parallel to and at a distance of the first main roller, wherein the first main roller and the second main roller are arranged in a main plane; and a decurling roller arranged parallel to and between the first and second main roller, when viewed in a direction perpendicular to the main plane, wherein the spacing between the first main roller and the second roller is smaller than the diameter of the decurling roller.

11 Claims, 3 Drawing Sheets

DEVICE FOR DECURLING A WEB OF MATERIAL, SUCH AS A PAPER WEB

CROSS-REFERENCE TO RELATED APPLICATION

This application claims priority to European Patent Application No. 14193002.4 filed Nov. 13, 2014, the disclosure of which is hereby incorporated in its entirety by reference.

BACKGROUND OF THE INVENTION

Field of the Invention

The invention relates to a device for decurling a web of material, such as a paper web, which device comprises:

a first main roller;

a second main roller arranged parallel to and at a distance of the first main roller, wherein the first main roller and the second main roller are arranged in a main plane; and a decurling roller arranged parallel to and between the first and second main roller, when viewed in a direction perpendicular to the main plane.

Description of Related Art

When a web of material, such as in particular paper, is fed through a machine between a number of rollers and especially when the material is heated on the way, such as in a printer, the web of material tends to curl.

The curling of the web of material complicates further handling of the material. Therefor, decurling devices are known to ensure that the web of material is outputted more or less flat.

For example U.S. Pat. No. 5,580,044 discloses a decurler. In this decurler two conveyor belts are placed against each other, such that a web of material can be transported between the two conveyor belts.

In the zone where the conveyor belts parts are adjacent each other, three rollers are placed alternately above and below this zone, such that path of the web of material can optionally be distorted into a zig zag path. By controlling the amount of distortion of the path, the amount of decurling can be set.

The construction of this device with two opposed conveyor belts and three rollers, which need to be set separately to control the decurling is complicated and therefor also expensive.

Furthermore, the diameter of the rollers cannot be decreased at will, as a smaller diameter will cause the roller to bend more easily by the tension in the web of material, such that the decurling effect is not equal over the width of the web of material. This will result in the edges of the web of material to curl up, while the center will be flat. However, the smaller the diameter of the decurling roller, the better the decurling effect will be under the condition that the decurling roller does not bend.

Finally, because the web of material is positioned between two conveyor belt, speed differences could occur between the two conveyor belts and the web, such that the web is damaged.

SUMMARY OF THE INVENTION

It is an object of the invention to reduce or even remove the above mentioned disadvantages.

This object is reached with a device characterized in that the spacing between the first main roller and the second roller is smaller than the diameter of the decurling roller.

With the device according to the invention a web of material is fed over the first main roller, than under the decurling roller and over the second roller. Because the decurling roller has a diameter larger than the spacing between the two main rollers, the decurling roller can be pulled against the two main rollers, by tensioning the web of material.

As a result the decurling roller is supported over the full length by the first and second main rollers, which provides the possibility to decrease the diameter of the decurling roller without the risk of the decurling roller to bend and without the risk of an uneven decurling of the web of material over its width.

So, very wide webs can easily and without any problems be decurled with a small diameter decurling roller. Also the leading edge of a web of material is better decurled compared to decurling devices according to the invention.

Furthermore, the web of material is in contact with over more than 180° of the circumference of the decurling roller, because the diameter of the decurling roller is larger than the spacing between the first main roller and the second roller. This also contributes to a more efficient decurling.

Preferably, at least one of the first main roller and second main roller is driven. This allows the device to work autonomously. The driven roller typically will pull the web of material through the device.

In a preferred embodiment of the device according to the invention at least one conveyor belt runs along the first main roller, the decurling roller and the second main roller.

When the web of material is too fragile to take up the tension necessary to pull the material through the device, the conveyor belt will provide for the necessary support.

With the conveyor belt it is also possible to control the force with which the decurling roller is pulled against the first and second main roller. This will contribute to the controlability of the decurling action.

The conveyor belt also ensures that all rollers are synchronized and only one roller needs to be driven.

In a further preferred embodiment of the device according to the invention a drive roller is provided parallel to the first and second main rollers, and wherein the at least one conveyor belt also runs along the drive roller.

Preferably, the drive roller is movable in at least the direction perpendicular to the main plane to control the tension in the at least one conveyor belt.

By providing a separate drive roller, the drive means can be positioned within the device at a suitable place outside of the path of the web of material.

By having the drive roller to be able to move in the direction perpendicular to the main plane, it is possible to control the tension in the conveyor belt and accordingly the force with which the decurling roller is pulled against both main rollers. It also allows to provide the conveyor belt some slack, such that the leading edge of a web of material is easily manually fed into the device, or be removed in case of any malfunction or when the rollers need to be cleaned.

Furthermore, it is possible to have the drive roller arranged partially in a bath for wetting the conveyor belt with a fluid arranged in the bath, which in turn will coat the web of material when it is fed through the decurling device of the invention. The fluid will be transported along with the conveyor belt and will accumulate between the rollers along which the material will be transported.

In a further embodiment of the device according to the invention the drive roller is crowned. Having a crowned drive roller ensures that the conveyor belt stays centered with respect to the rollers, even if any outside deviations would exert some force in axial direction on the conveyor belt.

Preferably, the at least one conveyor belt has a width substantially equal to the length of the decurling roller. This ensures that the web of material is supported equally over the full width of the web.

Yet another embodiment of the device according to the invention comprises a guide plate having a fold and curved parts on both sides of the fold, wherein the fold extends into the pinch between the first main roller and the second main roller, and wherein the fold line is parallel to the main rollers.

The guide plate will guide a leading edge of a web of material into the pinch of the first and second main roller, such that it is fed into the pinch of the first main roller and the decurling roller. This allows automatic feeding of webs of material, such as sheets of paper.

Still a further embodiment of the device according to the invention further comprises a housing having an inlet opening and an outlet opening for passing a web of material through the device, wherein both ends of the decurling roller are positioned close to one of the walls of the housing.

As the decurling roller will be supported by the web of material and/or the at least one conveyor belt, it is not required to provide any further suspension of the decurling roller. In such a case the decurling roller could move in axial direction. By having a housing, the axial direction of the decurling roller is easily restricted by the walls of the housing.

The width of the conveyor belt can be substantially equal to the length of the decurling roller, although it is advisable to ensure, that the width of the conveyor belt to be smaller than the distance between the walls of the housing.

By providing a keyhole in one of the walls of the housing, the decurling roller could be exchanged for example for a decurling roller with a larger or smaller diameter.

In a further embodiment of the device according to the invention the decurling roller is freely movable in a direction parallel to the radial and tangential direction of either the first main roller or the second main roller.

This allows for the web of material to pull the decurling roll against the main rollers and allows for the decurling roll to freely settle, such that the pressure of the decurling roll as a result of the tension in the web of material is evenly distributed over the length of the main rollers.

The invention also relates to a combination of a web of material and a device according to the invention, wherein the web of material starts and ends on the side of the main plane opposite of side, where the decurling roller is positioned.

This ensures, that the decurling roll will hang in the web of material and can be pulled via the web of material against the main rollers.

In a further embodiment of the combination according to the invention the web of material extends along the surface of the first main roller, through the nip of the first main roller and the decurling roller, then along the surface of the decurling roller, through the nip of the second main roller and along the surface of the second main roller.

A number of devices according to the invention can be arranged next to each other, for example to handle a large stream of materials or to be able to output decurled paper at different levels. The feed of the material could therefor be provided with a flap, which will guide the material to one of the desired decurling devices of the invention. This flap could also guide the material to a bypass such that selected pieces of material are not fed to the decurling device of the invention.

BRIEF DESCRIPTION OF THE DRAWINGS

These and other features of the invention will be elucidated in conjunction with the accompanying drawings.

DESCRIPTION OF THE INVENTION

Figure 1:
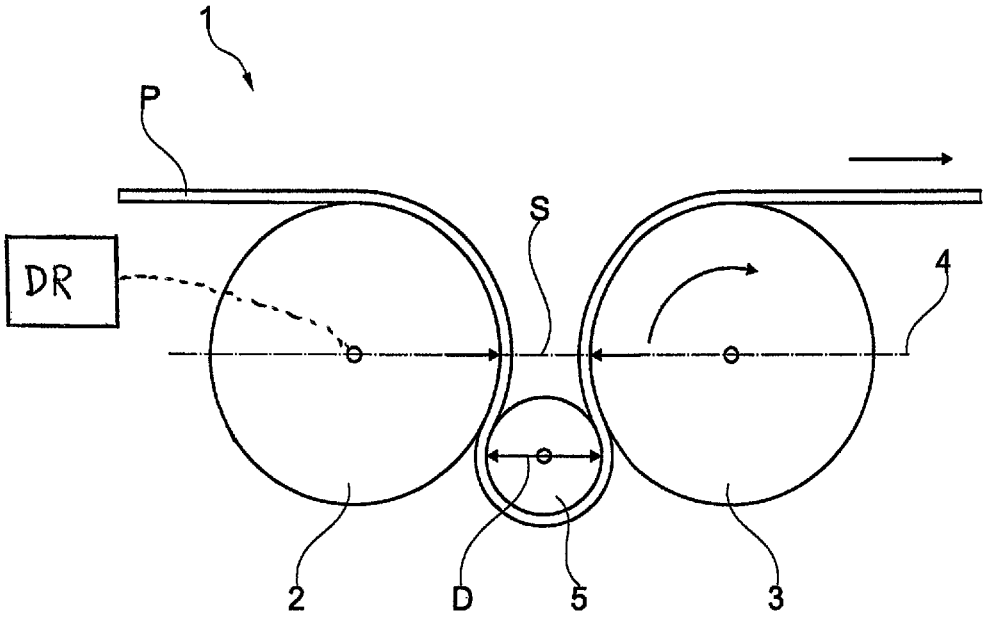
FIG. 1 shows a cross sectional view of a first embodiment of a device according to the invention.

FIG. 1 shows a cross sectional view of a first embodiment 1 of a device according to the invention.

The device 1 has two parallel main rollers 2, 3 arranged in a main plane 4. The main rollers 2, 3 are arranged at a distance of each other with a spacing S.

A decurling roller 5 is arranged parallel to and between the first main roller 2 and the second main roller 3, when viewed in a direction perpendicular to the main plane. The diameter D of the decurling roller 5 is larger than the spacing S. Furthermore, the axis of the decurling roller 5 is positioned below the main plane 4.

A web of paper P is guided along the top of the first main roller 2, along the bottom of the decurling roller 5 and back over the top of the second main roller 3.

When the second main roller 3 is driven by a driver DR, the paper P will be pulled through the device 1 and the decurling roller 5 will be pulled up by the tension in the paper P, and will cause that the paper P is squeezed between the first main roller 2 and the decurling roller 5 and is squeezed between the second main roller 3 and the decurling roller 5.

In theory the diameter D could be a little smaller than the spacing S, under the condition that the thickness of the paper P is sufficient such that the decurling roller 5 cannot pass the space between the main roller 2, 3. However, it is preferred that the diameter D is larger than the spacing S, such that it is ensured that the decurling roller 5 cannot pass the space between the main rollers 2, 3, independent from the paper thickness.

Figure 2:
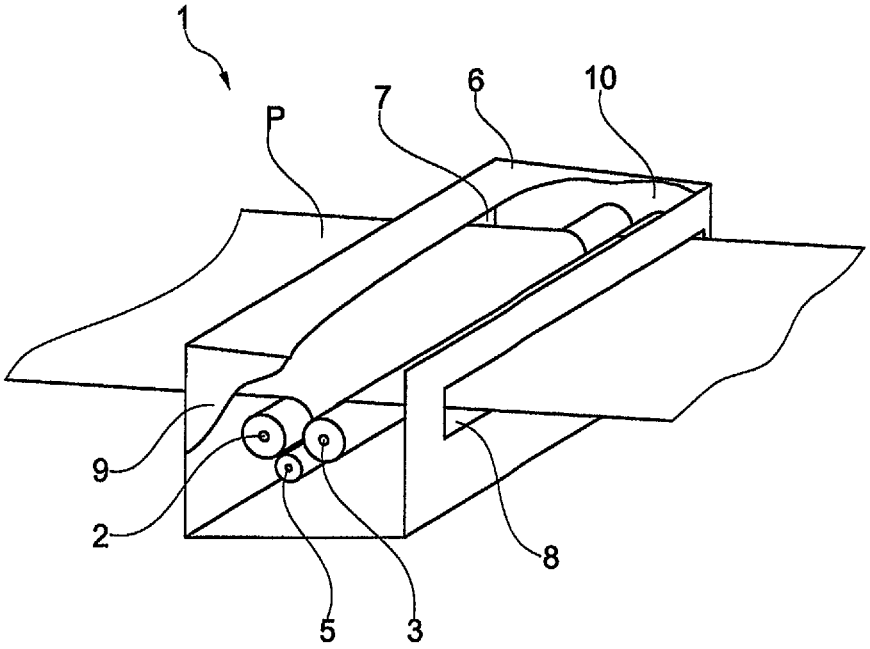
FIG. 2 shows a perspective view with partially cut-away portions of the device of FIG. 1.

FIG. 2 shows a perspective view with partially cut-away portions of the device 1 of FIG. 1.

The device 1 has a housing 6 with an inlet opening 7 and an outlet opening 8. Due to the side walls 9, 10 the decurling roller 5 can only be supported by the paper P and will stay in axial position.

Figure 3:
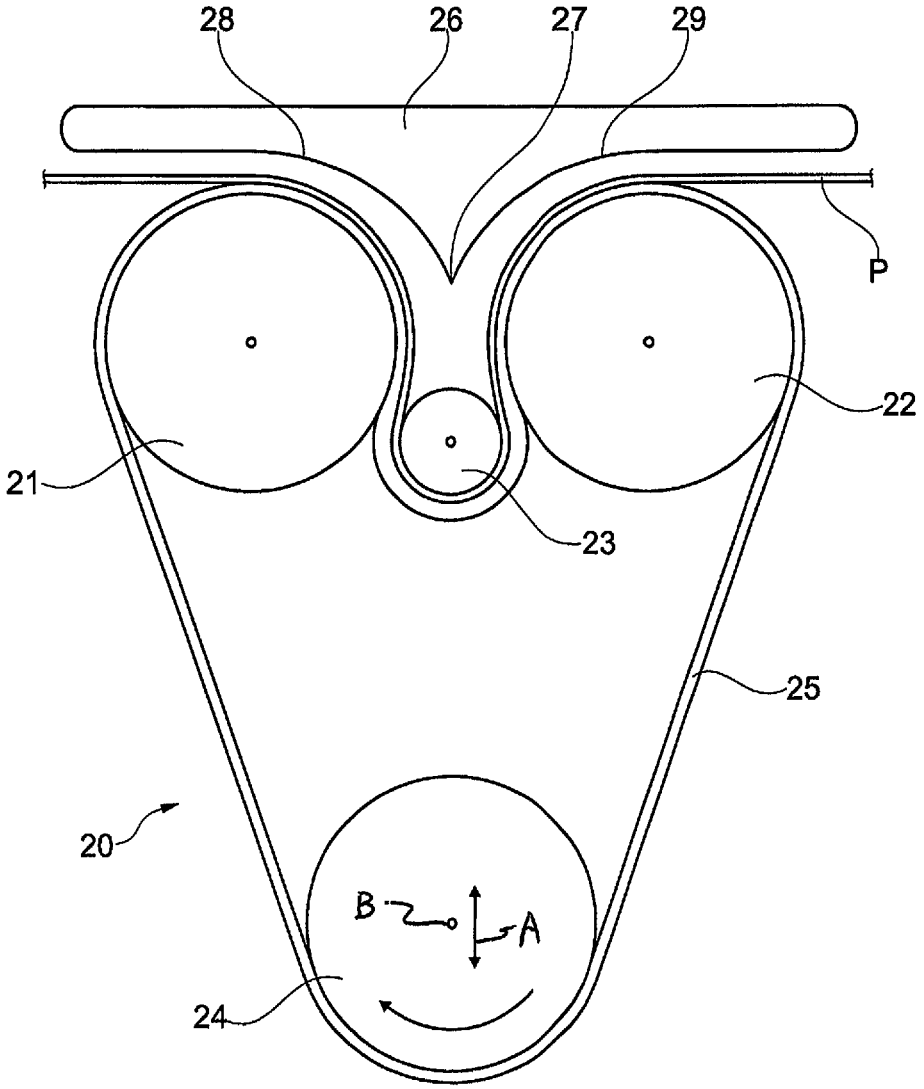
FIG. 3 shows a cross sectional view of a second embodiment of a device according to the invention.

FIG. 3 shows a cross sectional view of a second embodiment 20 of a device according to the invention. This device 20 has a first main roller 21, a second main roller 22 and a decurling roller 23 arranged parallel to and between the first main roller 21 and second main roller 22. Furthermore, the axis of the decurling roller 23 is positioned below the main plane of the rollers 21, 22.

A drive roller 24 is arranged beneath the main rollers 21, 22 and the decurling roller 23. The drive roller 24 is fixed about an axis B and rotates about the axis B and is movable up and down as illustrated by the vertical arrow A.

A conveyor belt 25 is wound along the top of the first main roller 21, beneath the decurling roller 23, over the second main roller 22 and under the drive roller 24. By driving the drive roller 24, all other rollers 21, 22, 23 will rotate, such that a web of paper P is taken along a part of the conveyor belt 25 path.

By moving the drive roller 24 more down, the decurling roller 23 is pulled more firm against both main rollers 21, 22, while moving the drive roller 24 up will decrease the tension. In this way the amount of decurling can be controlled.

A guide plate 26 is arranged over the main rollers 21, 22. The guide plate 26 has a fold 27 and curved parts 28, 29 on both sides of the fold 27, such that a web of material, such as a sheet of P can automatically be fed to the device 20.

Figure 4:
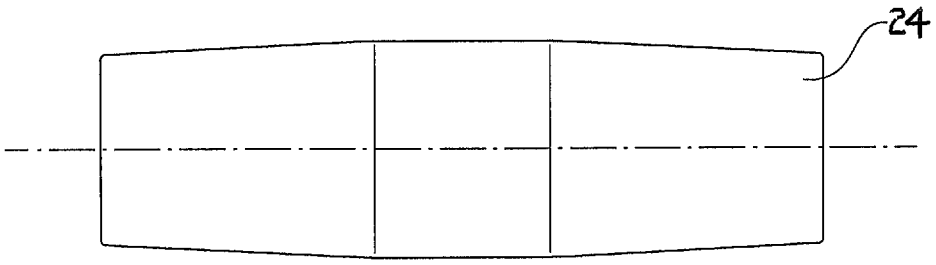
FIG. 4 is a side view of one embodiment of a drive roller showing a crown.

FIG. 3 shows a drive roller 24. In one embodiment, illustrated in FIG. 4, the drive roller is crowned.

It should be noted that in each embodiment, the decurling roller 5, 23 is supported only by the web of material P passing over the main rollers 2, 3 and the main rollers 21, 22.

The invention claimed is:

1. A device for decurling a web of material comprising:
a first main roller;
a second main roller arranged parallel to and at a distance from the first main roller, wherein the first main roller and the second main roller are arranged in a main plane;
a decurling roller arranged parallel to and between the first main roller and the second main roller, when viewed in a direction perpendicular to the main plane,
wherein the decurling roller has an axis and wherein the axis is positioned below the main plane;
wherein the decurling roller is supported only by the web of material passing over the main rollers such that the decurling roller is movable in a direction parallel to a radial and tangential direction of either the first main roller or the second main roller; and
wherein there is spacing between the first main roller and the second main roller and the spacing is smaller than a diameter of the decurling roller.

2. The device according to claim 1, wherein at least one of the first main roller and second main roller is driven by a driver.

3. The device according to claim 1, comprising a guide plate having a fold and curved parts on both sides of the fold, wherein the fold extends into a pinch between the first main roller and the second main roller, and wherein a fold line is parallel to the main rollers.

4. The device according to claim 1, further comprising a housing having opposing walls, an inlet opening and an outlet opening for passing a web of material through the device, wherein each end of the decurling roller is positioned adjacent to an opposing wall of the housing.

5. A combination of a web of material and a device according to claim 1, wherein the web of material starts and ends on a side of the main plane opposite of a side where the decurling roller is positioned.

6. The combination according to claim 5, wherein the web of material extends along a surface of the first main roller, through a space between the first main roller and the decurling roller, then along a surface of the decurling roller, through a nip of the second main roller and along a surface of the second main roller.

7. A device for decurling a web of material comprising:
a first main roller;
a second main roller arranged parallel to and at a distance from the first main roller, wherein the first main roller and the second main roller are arranged in a main plane;
a decurling roller arranged parallel to and between the first main roller and the second main roller, when viewed in a direction perpendicular to the main plane,
wherein the decurling roller has an axis and wherein the axis is positioned below the main plane;
wherein at least one conveyor belt runs along the first main roller, the decurling roller, and the second main roller;
wherein the decurling roller is supported only by the web of material passing over the main rollers and the at least one conveyor belt such that the decurling roller is movable in a direction parallel to a radial and tangential direction of either the first main roller or the second main roller; and
wherein there is spacing between the first main roller and the second main roller and the spacing is smaller than a diameter of the decurling roller.

8. The device according to claim 7, wherein a drive roller is provided parallel to the first and second main rollers, and wherein the at least one conveyor belt also runs along the drive roller.

9. The device according to claim 8, wherein the drive roller is fixed about and rotates about an axis and wherein the axis is movable in at least the direction perpendicular to the main plane to control tension in the at least one conveyor belt.

10. The device according to claim 8, wherein the drive roller is crowned.

11. The device according to claim 9, wherein the at least one conveyor belt has a width substantially equal to a length of the decurling roller.

* * * * *